US005323560A

United States Patent [19]

Wen

[11] Patent Number: 5,323,560

[45] Date of Patent: Jun. 28, 1994

[54] AUTOMOBILE POLISHER

[76] Inventor: Chen C. Wen, P.O. Box 82-144, Taipei, Taiwan

[21] Appl. No.: 134,008

[22] Filed: Oct. 12, 1993

[51] Int. Cl.[5] ..... B24B 23/02

[52] U.S. Cl. ..... 51/170 T; 15/97.3; 51/177

[58] Field of Search ..... 51/170 R, 170 T, 170 MT, 51/174, 177; 15/49.1, 97.1, 97.3, 28, 230

[56] References Cited

FOREIGN PATENT DOCUMENTS 0076955 5/1985 Japan ..... 51/170 T 2183514 10/1987 United Kingdom ..... 51/170 T

*Primary Examiner*—Roscoe V. Parker

*Attorney, Agent, or Firm*—Alfred Lei

[57] ABSTRACT

This disclosure relates to an automobile polisher and in particular to one including: a housing having a front handle and a rear handle for making it easier to be held; a clutch mechanism having a toothed ferrule, a control rod, a spring, a sliding disc and an axle, said control rod extending through said housing to engage with a main gear, said sliding disc being fitted between the main gear and said control rod so as to prevent said main gear from being damaged by said control rod; a gear changing mechanism composed of a first gear, a second gear, said main gear, a frame and a casing, said first gear being disposed at the right side of said main gear and pivotally mounted within said casing, said first gear being provided with upper threads and lower threads in which the former may be moved by the control lever to engage with the toothed ferrule, and the latter to engage with the upper threads of the main gear thereby transmitting the power to the frictional disc, said second gear being disposed at the left side of the main gear and pivotally mounted within the casing.

1 Claim, 6 Drawing Sheets

AUTOMOBILE POLISHER

BACKGROUND OF THE INVENTION

It has been found that in the prior art an automobile polisher sold on the market is simply composed of a motor, a foam-rubber member, and a piece of waxing cloth. However, such an automobile polisher is fixed in speed and so it will be too fast for applying wax but too slowly for finishing. Hence, an automobile polisher with variable speeds has been developed to eliminate the drawback. Nevertheless, this automobile polisher utilizes the principle of varying the electric current to adjust the speed thereby making the torque become smaller when the speed is decreased and therefore easily making the motor stop when subjected to pressure.

Therefore, it is an object of the present invention to provide an automobile polisher which may obviate and mitigate the above-mentioned drawbacks.

SUMMARY OF THE INVENTION

This invention relates to an improved an automobile polisher.

It the primary object of the present invention to provide an automobile polisher which is adjustable in speed.

It is another object of the present invention to provide an automobile polisher which is easy to operate.

It is still another object of the present invention to provide an automobile polisher which is simple in construction.

It is still another object of the present invention to provide an automobile polisher which can be regulated in torque.

It is a further object of the present invention to provide an automobile polisher which is fit for practical use.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of illustrating the details of an embodiment of the invention.

Figure 1:
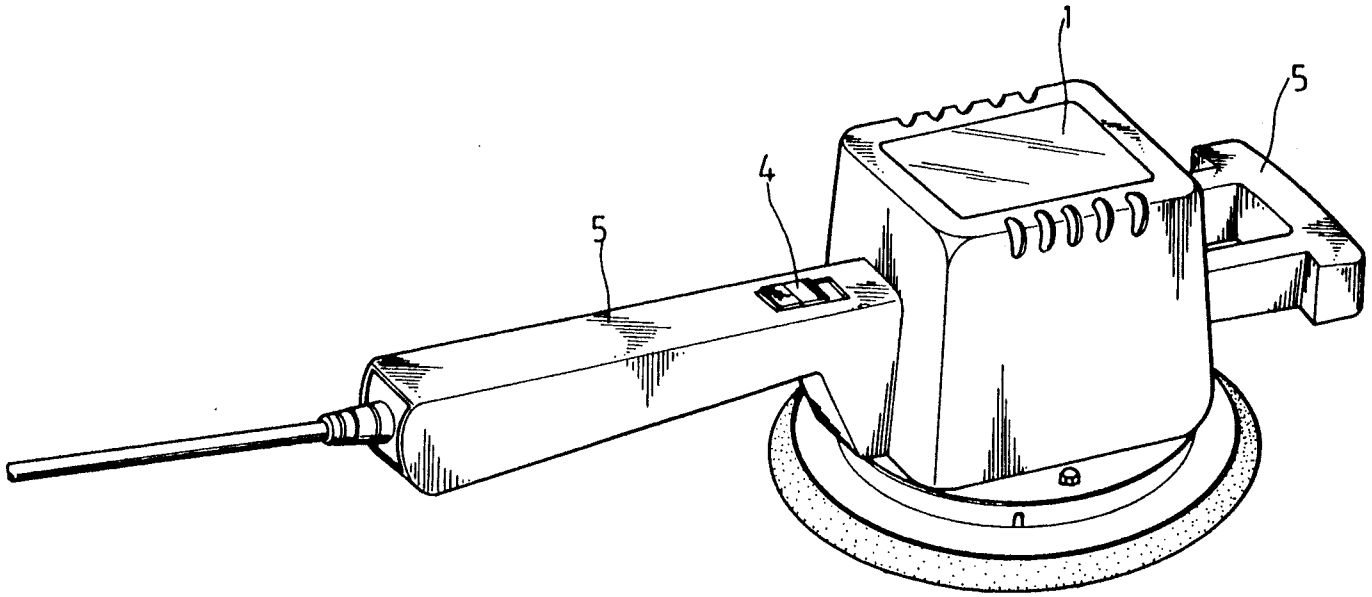
FIG. 1 is a perspective view of a waxing device according to the present invention.
Figure 2:
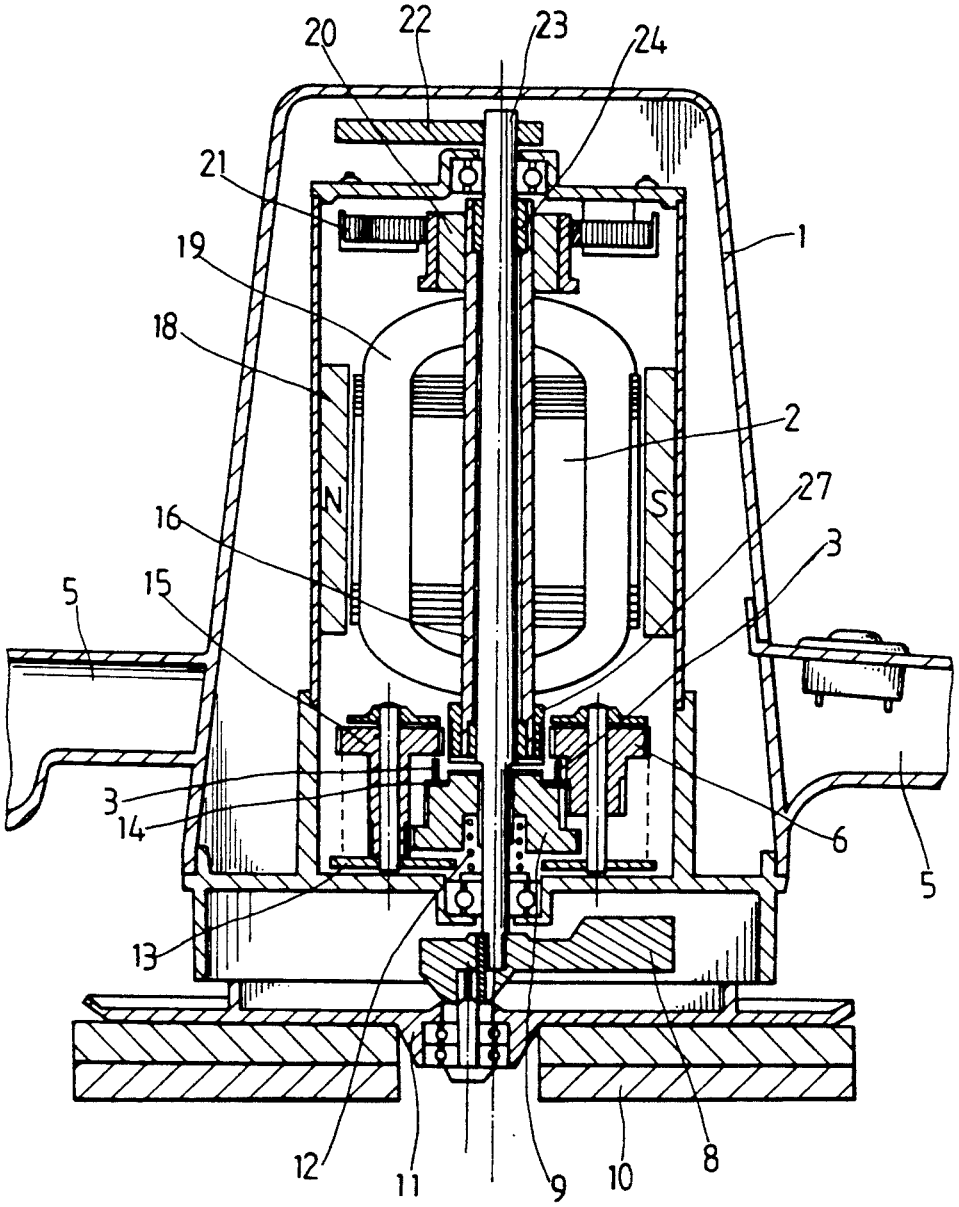
FIG. 2 is a sectional view of the waxing device.
Figure 3:
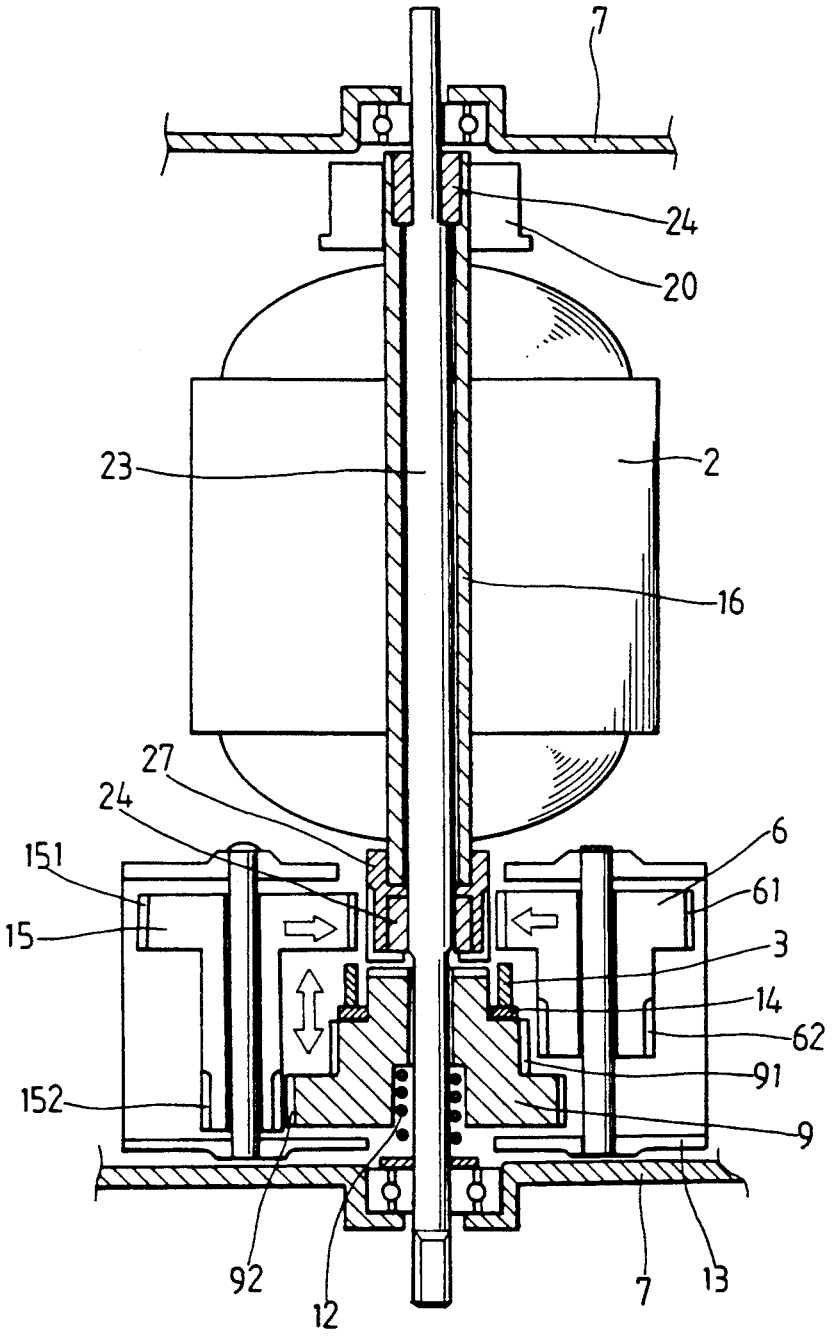
FIGS. 3, 4A, 4B, 5A, 5B and 5C show the working principle of the present invention.

With reference to the drawings and in particular to FIGS. 1, 2 and 3 thereof, the automobile polisher according to the present invention mainly comprises a housing, a driving mechanism, a gear changing mechanism, a clutch mechanism, a sleeve for the main shaft of the motor, and a weight.

The housing 1 includes a front handle 5 and a rear handle 5 for making it easier to be held. The driving mechanism is composed of a motor, a rotor 2, a magnet 18, a coil 19, a rectifier 20, and a pair of carbon brushes 21. The motor has a spindle 23 and a sleeve 16 enclosing the spindle 23. The spindle 23 is supported by a bearing 24 at both ends. The lower end of the sleeve 16 is engaged with a toothed ferrule 27.

The clutch mechanism is composed of a toothed ferrule 27, a control rod 3 (see FIGS. 4A and 4B), a spring 12, a sliding disc 14, and an axle 25. Under the toothed ferrule 27 there is a main gear 9 mounted on the spindle 23 and threadedly engageable with the toothed ferrule 27.

The control rod 3 extends through the housing 1 to engage with the main gear 9. Under the main gear 9 there is a spring 12. The sliding disc 14 is fitted between the main gear 9 and the control rod 3 so as to prevent the main gear 9 from being damaged by the control rod 3.

The gear changing mechanism is composed of a first gear 6, a second gear 15, the main gear 9, a frame 13, and a casing 7.

Figure 4A:
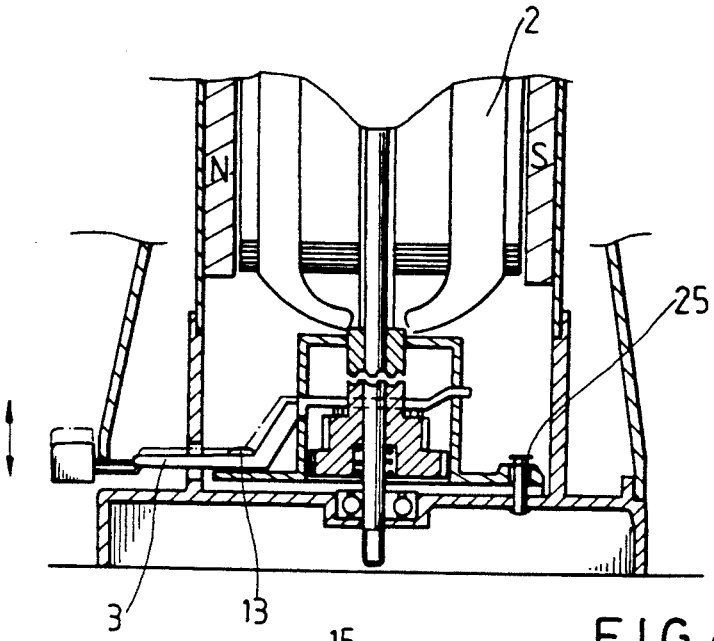
Figure 4B:
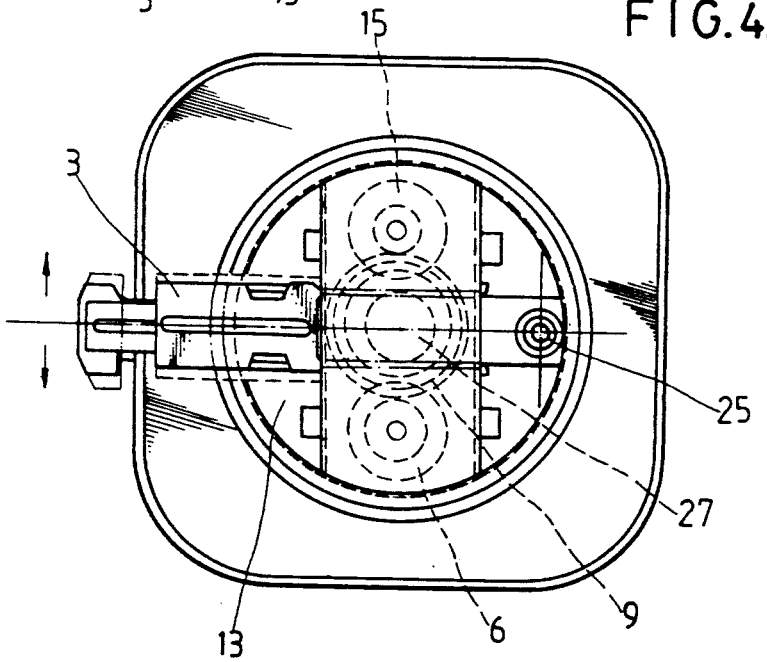
Figures 5A, 5B, 5C:
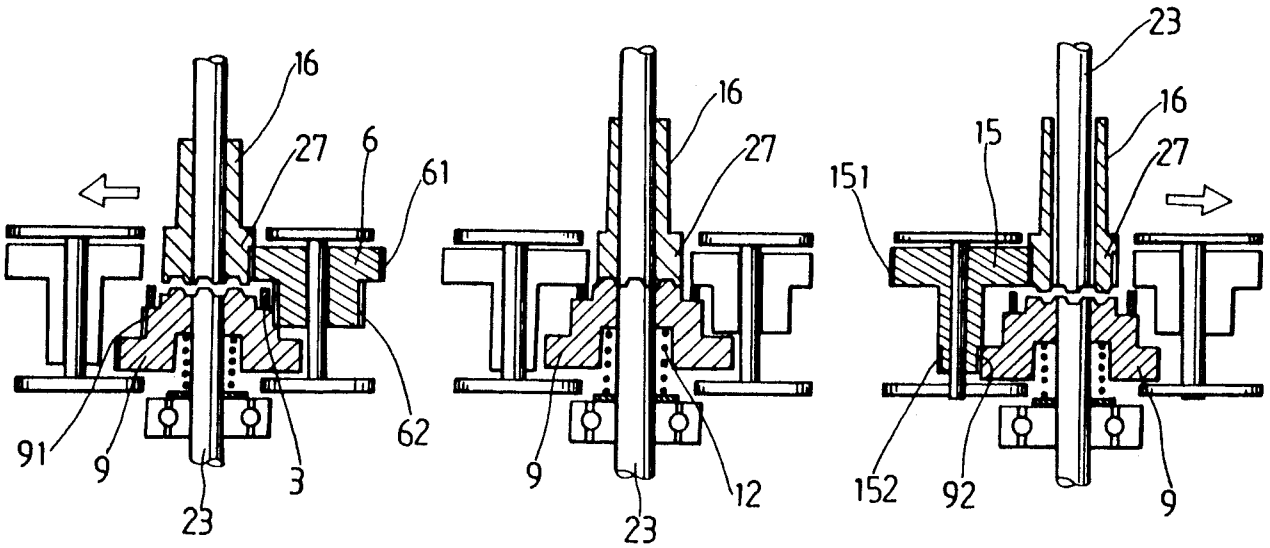
Figure 6:
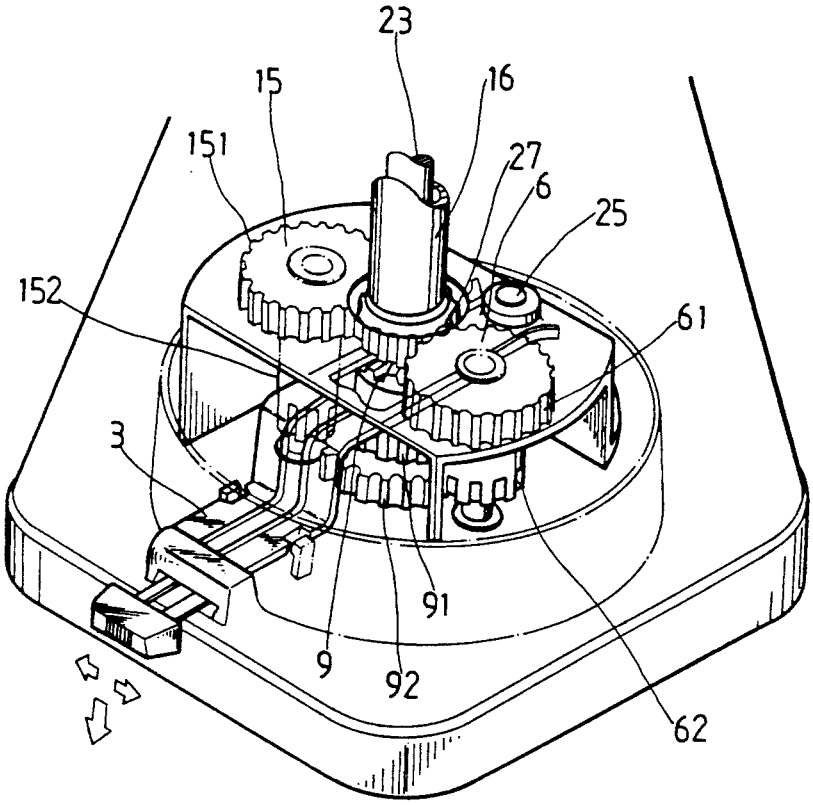
FIG. 6 is a perspective view showing the structure of the present invention.

As shown in FIGS. 3, 4A and 4B, the first gear 6 is disposed at the right side of the main gear 9 and pivotally mounted within the casing 13. The first gear 6 is provided with upper threads 61 and lower threads 62 in which the former may be moved by the control lever 3 to engage with the toothed ferrule 27, and the latter to engage with the upper threads of the main gear 9 thereby transmitting the power to the frictional disc 11. The second gear 15 is disposed at the left side of the main gear 9 and pivotally mounted within the casing 13. The second gear 15 is similar to the first gear in structure, but has a different number of teeth than the first gear 6. Also, the second gear 15 is provided with upper threads 151 and lower threads 152 (see FIG. 5C) in which the former may be moved by the control lever 3 to engage with the main gear 9, and the latter to engage with the lower threads 92 of the main gear 9 thereby transmitting the power to the frictional disc 11. In addition, a sponge is mounted on the bottom of the frictional disc 11.

Looking back to FIG. 2, the first eccentric weight 8 and the second eccentric weight 22 are mounted on the upper end and lower end of the spindle 23 respectively.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An automobile polisher comprising:

a housing having a front handle and a rear handle for making it easier to be held;

a clutch mechanism having a toothed ferrule, a control rod, a spring, a sliding disc and an axle, said control rod extending through said housing to engage with a main gear, said sliding disc being fitted between the main gear and said control rod so as to prevent said main gear from being damaged by said control rod;

a gear changing mechanism composed of a first gear, a second gear, said main gear, a frame and a casing, said first gear being disposed at the right side of said main gear and pivotally mounted within said casing, said first gear being provided with upper threads and lower threads in which the former may be moved by the control lever to engage with the toothed ferrule, and the latter to engage with the upper threads of the main gear thereby transmitting the power to the frictional disc, said second gear being disposed at the left side of the main gear and pivotally mounted within the casing.

* * * * *